United States Patent [19]

Shekleton et al.

[11] Patent Number: 5,076,061

[45] Date of Patent: Dec. 31, 1991

[54] STORED ENERGY COMBUSTOR

[75] Inventors: Jack R. Shekleton, San Diego; Robert W. Smith, Lakeside, both of Calif.

[73] Assignee: Sundstrand Corporation, Rockford, Ill.

[21] Appl. No.: 451,145

[22] Filed: Dec. 15, 1989

[51] Int. Cl.[5] ..... F02C 1/00

[52] U.S. Cl. ..... 60/748; 60/760; 60/39.827

[58] Field of Search ..... 60/748, 760, 743, 39.36, 60/737, 744, 39.12, 39.141, 39.142, 39.821, 39.827, 727, 733, 746, 752; 431/254, 258, 260, 263, 264, 265, 266

[56] References Cited

U.S. PATENT DOCUMENTS

| | | | |
|---|---|---|---|
| Re. 23,149 | 9/1949 | Lubbock et al. | 60/760 |
| 2,720,753 | 10/1955 | Sharpe . | |
| 3,912,164 | 10/1975 | Lefebvre et al. | 60/748 |
| 3,972,182 | 8/1976 | Salvi . | |
| 4,023,351 | 5/1977 | Beyler et al. | 60/748 |
| 4,150,539 | 4/1979 | Rubins et al. . | |
| 4,301,656 | 11/1981 | Stettler | 60/737 |
| 4,343,148 | 8/1982 | Shekleton | 60/744 |
| 4,373,325 | 2/1983 | Shekleton | 60/737 |
| 4,466,240 | 8/1984 | Miller . | |
| 4,777,793 | 10/1988 | Weigand et al. . | |

OTHER PUBLICATIONS

Fischer, "Evaluation of Less Toxic Fuels for Aircraft Emergency Power Systems", SAE Technical Paper Series, No. 851974 (Oct. 1985).

Klaass, "Power System for 21st Century Fighter Aircraft", SAE Technical Paper Series, No. 892253 (Sep. 1989).

*Primary Examiner*—Louis J. Casaregola
*Assistant Examiner*—Timothy S. Thorpe
*Attorney, Agent, or Firm*—Wood, Phillips, Mason, Recktenwald & VanSanten

[57] ABSTRACT

In order to significantly reduce the carbon produced in a combustor, and thus reduce or eliminate carbon buildup on a combustor wall (14), a stored energy combustor (10) has a fuel injector (28) in a tubular extension (16) of a vessel (12) leading to a combustion chamber (20). The fuel injector (28) has a discharge end (60) upstream of a plane defining a point of entry (32) into the combustion chamber (20) for directing an annulus of fuel (26) toward the combustion chamber (20), and an oxidant inlet port (24) is also provided upstream of the combustion chamber (20) for directing oxidant into the combustion chamber (20) through the tubular extension (16) in surrounding relation to the fuel injector (28) which is concentric with the longitudinal axis (22) of the vessel (12). In addition, the stored energy combustor (10) includes an air swirler (34) upstream of the combustion chamber (20) and the discharge end (60) of the fuel injector (28) for swirling oxidant in the tubular extension (16) which directs oxidant in a swirling annulus (46) into the combustion chamber (20) outwardly of the annulus of fuel (26).

13 Claims, 2 Drawing Sheets

STORED ENERGY COMBUSTOR

FIELD OF THE INVENTION

The present invention is directed to a stored energy combustor and, more particularly, a stored energy combustor minimizing carbon buildup.

BACKGROUND OF THE INVENTION

Stored energy combustors have long been utilized for producing hot gases under pressure to operate turbine engines. In such stored energy combustors, a carbonaceous fuel is typically combusted with an oxidant to produce hot gases of combustion, and additional fuel may typically be introduced into the hot gases of combustion to be vaporized, or partly decomposed, or both. By so doing, the volume of hot gas can be increased while bringing the temperature of the combustion gas down to a temperature incapable of causing damage to the turbine engine.

One difficulty in the operation and use of such stored combustors is carbon buildup which results when the fuel is not completely oxidized and elemental carbon is formed within or downstream of the combustion chamber. It is important to keep the internal walls of the stored energy combustor free of carbon buildup since such carbon can break away and cause damage to downstream components and can also impair the efficiency of the combustor and turbine engine. To this end, carbon buildup can be avoided by providing an excess of oxidant within the combustion chamber but this necessarily results in excessive consumption of oxidant during operation of the stored energy combustor.

On the other hand, there is ordinarily a plentiful supply of liquid fuel in most cases. It has thus been conventional practice to run stored energy combustors on the rich side so that all available oxidant is consumed during combustion to thereby minimize oxidant consumption. However, by so doing, the potential for carbon buildup is increased.

As pointed out in Parrin U.S. Pat. No. 1,828,784, issued Oct. 27, 1931, it is also desirable to cool the combustion chamber to prevent damage thereto by excessive heat from combustion occurring therein. Advantageously, this is accomplished by cooling the combustion chamber with fuel, but the fuel may get overly hot causing gumming up leading to rapid failure and, furthermore, the fuel starts to boil which makes fuel injector design difficult and causes serious control system instabilities. At lower power settings, this fuel overheating is particularly troublesome because the low pressure in the combustion chamber results in fuel boiling at even lower temperatures.

As already suggested, carbon buildup is undesirable because it may interfere with heat transfer, but another problem resulting from carbon buildup is much more serious. Specifically, stored energy combustors are frequently used to produce hot gases for driving a turbine wheel. As carbon builds up, particles thereof typically break free and then flow with the hot gases of combustion through the turbine wheel. Unfortunately, particulate carbon is known to erode the turbine nozzle and the turbine wheel. Furthermore, carbon deposits can build up on the surface of the turbine nozzle and restrict the flow of hot gases to the turbine wheel which can cause an undesired performance loss.

Still another problem associated with excessive carbon production is the existence of a massive black exhaust plume which is highly undesirable.

Presently, it is believed that a substantial portion of the carbon produced is a result of liquid phase pyrolysis during liquid fuel droplet evaporation. It is also quite likely that some gas phase carbon is produced as the result of the cracking reactions which occur in practice. However, the gas phase carbon is on the molecular level and much less harmful than liquid phase carbon which is on the order of microns for purposes of comparison.

Since it is believed that the carbon is a result of liquid phase pyrolysis, it is essential to achieve rapid fuel evaporation. This is the best known manner of minimizing liquid phase carbon. However, stored energy combustors have not been entirely satisfactory in addressing these serious carbon problems.

While addressing all of the foregoing problems, it is also necessary to make it possible to achieve ignition without any substantial difficulty which can be accomplished by enlarging the combustor to reduce velocity. However, this is known to produce a problem in terms of oversizing. Accordingly, any practical solution must take into account weight and spacing savings in the combustor, reduction in propellant consumption by enhanced cracking, and consequent substantial reductions in carbon and smoke.

The present invention is directed to overcoming one or more of the foregoing problems and achieving one or more of the resulting objects.

SUMMARY OF THE INVENTION

It is the principal object of the present invention to provide a new and improved stored energy combustor. More specifically, it is an object of the invention to provide a stored energy combustor having a fuel injector capable of providing a stratified and laminar hot, vaporized annulus of fuel. It is also an object of the invention to provide a stored energy combustor having an annulus of flame which does not initially mix with a heavier swirling oxidant annulus radially outwardly thereof. It is yet another object of the present invention to provide a combustor which causes the swirling mass of oxidant, flame and fuel to expand so as to increase turbulence and enhance mixing and reaction of fuel and oxidant.

An exemplary embodiment of the invention achieves the foregoing in a stored energy combustor comprising a vessel having an interior wall defining narrow, spaced apart inlet and outlet ends. The inlet and outlet ends are interconnected by a relatively wide combustion chamber, and the vessel has a longitudinal axis extending from the inlet end through the combustion chamber to the outlet end thereof. With this general understanding of the invention, the inlet end and outlet end are generally tubular extensions of the vessel leading to and from the combustion chamber, respectively.

The stored energy combustor includes an oxidant inlet port upstream of the combustion chamber for directing oxidant into the combustion chamber through the tubular extension of the vessel leading to the combustion chamber. The oxidant inlet port is generally concentric with the longitudinal axis of the vessel at the inlet end thereof. Still further, the stored energy combustor includes fuel injection means in the tubular extension of the vessel leading to the combustion chamber for directing an annulus of fuel toward the combustion chamber.

In this connection, the fuel injection means has a discharge end upstream of a plane defining a point of entry into the combustion chamber. Also, the fuel injection means is generally concentric with the longitudinal axis of the vessel. With this arrangement, the oxidant inlet port is adapted to direct oxidant into the combustion chamber in surrounding relation to the fuel injection means.

In addition, the stored energy combustor includes means upstream of the combustion chamber and the discharge end of the fuel injection means for swirling the oxidant. The tubular extension of the vessel leading to the combustion chamber is thus adapted to direct oxidant in a swirling annulus into the combustion chamber outwardly of the annulus of fuel. Still further, the stored energy combustor includes means for igniting the oxidant and the fuel so as to produce hot gases of combustion.

In a highly preferred embodiment, the fuel injection means comprises a fuel injector including a double-walled hollow tube defining a fuel passageway extending in generally concentric relation to the longitudinal axis of the vessel. The igniting means is then advantageously disposed within the double-walled hollow tube radially inwardly of the fuel passageway or, alternatively, within the wall of the vessel at a point within the combustion chamber for igniting oxidant from the oxidant inlet port and fuel from the fuel injector. Still further, the fuel injector is formed such that the fuel passageway terminates in a cylindrical fuel nozzle whereby the annulus of fuel is in the form of a cylindrical array of fine fuel droplets directed toward the combustion chamber.

In a most highly preferred embodiment, the discharge end of the fuel injector is located upstream of a plane at the juncture of the tubular extension and the combustion chamber. This plane serves to define the point of entry into the combustion chamber for advantageously directing the generally laminar annulus of fine fuel droplets along the tubular extension toward the combustion chamber. As a result, the tubular extension of the vessel leading to the combustion chamber directs oxidant into the combustion chamber in a swirling annulus outwardly of the generally laminar annulus of fine fuel droplets.

In addition, the swirling oxidant annulus is adapted to expand radially outwardly upon entering the combustion chamber and contract radially inwardly upon exiting the combustion chamber. The expanding and contracting swirling oxidant annulus causes a major zone of recirculating gases inwardly of the wall defining the combustion chamber and also causes a minor zone of recirculating gases inwardly of the wall defining the tubular extension of the vessel leading to the combustion chamber. The generally laminar annulus of fine fuel droplets is directed between the swirling oxidant annulus and the minor zone of recirculating gases within the tubular extension upstream of the combustion chamber.

Other objects, advantages and features of the present invention will become apparent from a consideration of the following specification taken in conjunction with the accompanying drawings.

DETAILED DESCRIPTION OF THE PREFERRED EMBODIMENTS

Figure 1:
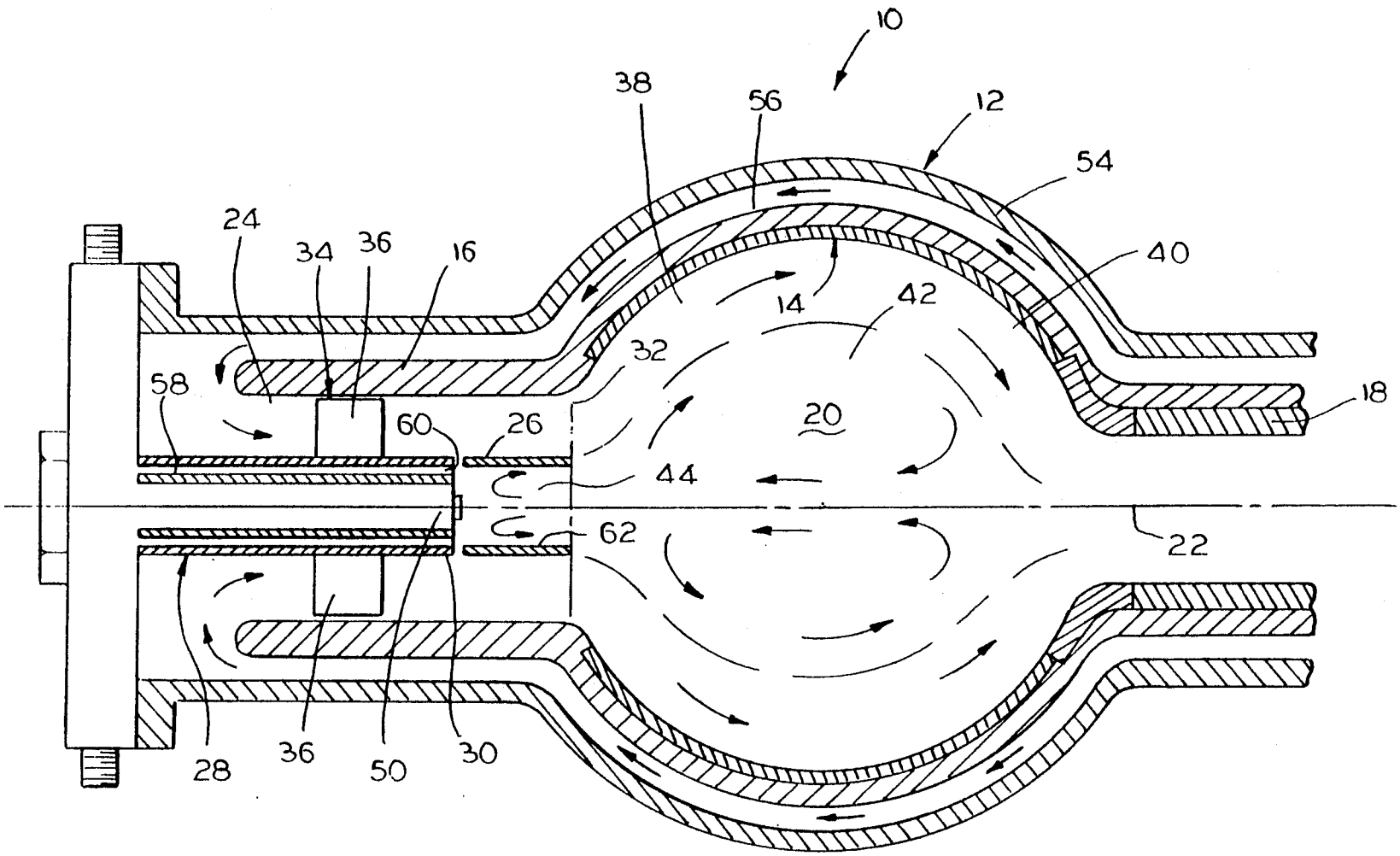
FIG. 1 is a partially schematic, partially sectional view of a stored energy combustor in accordance with the present invention.

In the illustration given, and with reference first to FIG. 1, the reference numeral 10 designates generally a stored energy combustor in accordance with the present invention. The stored energy combustor 10 comprises a vessel 12 having an interior wall 14 defining narrow, spaced apart inlet and outlet ends 16 and 18 interconnected by a relatively wide combustion chamber 20 wherein a longitudinal axis 22 extends from the inlet end 16 through the combustion chamber 20 to the outlet end 18 thereof. The combustion chamber 20 is generally spherical in shape with the inlet end 16 and outlet end 18 comprising generally tubular extensions of the vessel 12 leading to and from the combustion chamber 20. The stored energy combustor 10 also comprises an oxidant inlet port 24 upstream of the combustion chamber 20 for directing oxidant into the combustion chamber 20 through the tubular extension 16 and comprises fuel injection means in the tubular extension 16 for directing a generally laminar annulus of fine fuel droplets as at 26 along the tubular extension 16 toward the combustion chamber 20. As will be appreciated from FIG. 1, the fuel injection means comprises a fuel injector 28 having a discharge end 30 upstream of a plane at the juncture of the tubular extension 16 and the combustion chamber 20 at the point of entry as at 32 into the combustion chamber 20.

Still referring to FIG. 1, the oxidant inlet port 24 and the fuel injector 28 are both concentric with the longitudinal axis 22 of the vessel 12 at the inlet end 16 thereof. It will also be appreciated that the oxidant inlet port 24 is arranged so as to direct oxidant into the combustion chamber 20 in surrounding relation to the fuel injector 28 and the generally laminar annulus of fine fuel droplets as at 26. Still additionally, means are provided upstream of the combustion chamber 20 and the discharge end 30 of the fuel injector 28 for swirling the oxidant in the tubular extension 16 of the vessel 12.

More specifically, the oxidant swirling means comprises an air swirler 34 having a plurality of vanes 36 for spinning oxidant in the tubular extension 16 of the vessel 12 upstream of the combustion chamber 20 to a swirl angle of between approximately 40 and 70 degrees. Thus, the tubular extension 16 is adapted to direct oxidant in a swirling annulus into the combustion chamber 20 outwardly of the generally laminar annulus of fine fuel droplets as at 26 where the swirling oxidant annulus expands radially outwardly within the combustion chamber 20 as at 38 upon exiting the tubular extension 16 and contracts radially inwardly within the combustion chamber 20 as at 40 upon approaching the tubular extension 18, i.e., the exit from the combustion chamber 20. The swirling oxidant causes a major zone of recirculating gases as at 42 inwardly of the portion of the interior wall 14 defining the spherical combustion chamber 20 and a minor zone of recirculating gases as at 44 inwardly of the portion of the interior wall 14 defining the tubular extension 16 (see, also, FIG. 2).

Figure 2:
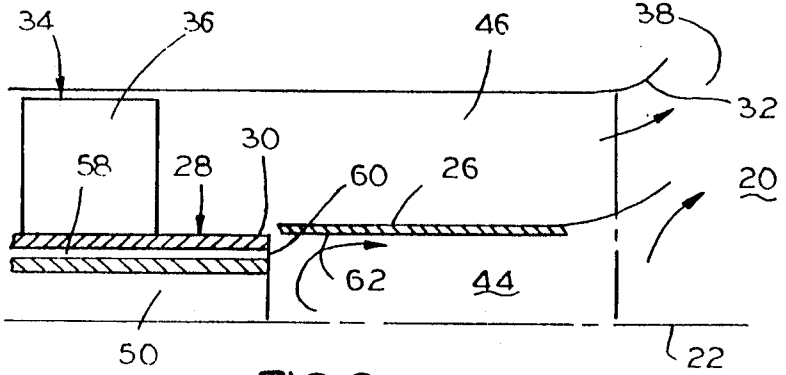
FIG. 2 is an enlarged detail view of a portion of the stored energy combustor of FIG. 1 illustrating an annulus of fuel directed toward a combustion chamber.

Referring specifically to FIG. 2, it will be appreciated that the generally laminar annulus of fine fuel droplets as at 26 is directed inwardly of the swirling oxidant annulus as at 46 in the tubular extension 16 prior to entry into the combustion chamber 20. Likewise, it will be seen that the generally laminar annulus of fine fuel droplets as at 26 is directed outwardly of the minor zone of recirculating gases as at 44. In other words, the generally laminar annulus of fine fuel droplets as at 26 is directed between the swirling oxidant annulus as at 46 and the minor zone of recirculating gases as at 44 within the tubular extension 16 leading to the combustion chamber 20.

Referring once again to FIG. 1, the stored energy combustor 10 also includes means for igniting the oxidant and the fuel to produce hot gases of combustion. More specifically, the igniting means advantageously comprises either an igniter 50 which is centrally disposed within the fuel injector 28 (FIG. 1) or an igniter 52 which is disposed within the interior wall 14 of the vessel 12 (see FIG. 1*a*). In either case, the igniter 50 or the igniter 52 is well suited and well situated for igniting the oxidant and the fuel to produce hot gases of combustion in the combustor 10.

As shown in FIG. 1, the vessel 12 also advantageously has an exterior wall 54 in closely spaced relation to the interior wall 14 to define an oxidant flow path 56 extending substantially completely about the vessel 12 from the outlet end 18 to the inlet end 16 thereof. In this manner, oxidant can be delivered to the oxidant inlet port 24 while serving to cool the interior wall 14 substantially along the entire length of the vessel 12 as it flows along the path 56 from a source (not shown).

Referring to FIGS. 1 and 2, the fuel injector 28 preferably comprises a double-walled hollow tube defining a fuel passageway 58 extending in generally concentric relation to the longitudinal axis 22 of the vessel 12. It will be appreciated that the fuel injector 28 is formed such that the fuel passageway 58 terminates in a cylindrical fuel nozzle 60 for directing the generally laminar annulus of fine fuel droplets as at 26 toward the combustion chamber 20. With this arrangement, the igniter 50 is disposed within the double-walled hollow tube of the fuel injector 28 radially inwardly of the fuel passageway 58 for igniting the oxidant and the fuel in the combustion chamber 20.

Referring once again to FIG. 1*a*, the igniter 52 is disposed within the interior wall 14 of the vessel 12 in this embodiment. More specifically, the igniter 52 is located within the interior wall 14 at a point within the combustion chamber 20 for igniting a mixture of oxidant from the oxidant inlet port 24 and fuel from the fuel injector 28. In other words, the igniter 50 in the embodiment of FIG. 1 has been eliminated in favor of the igniter 52 in the embodiment of FIG. 1*a*.

Figure 1A:
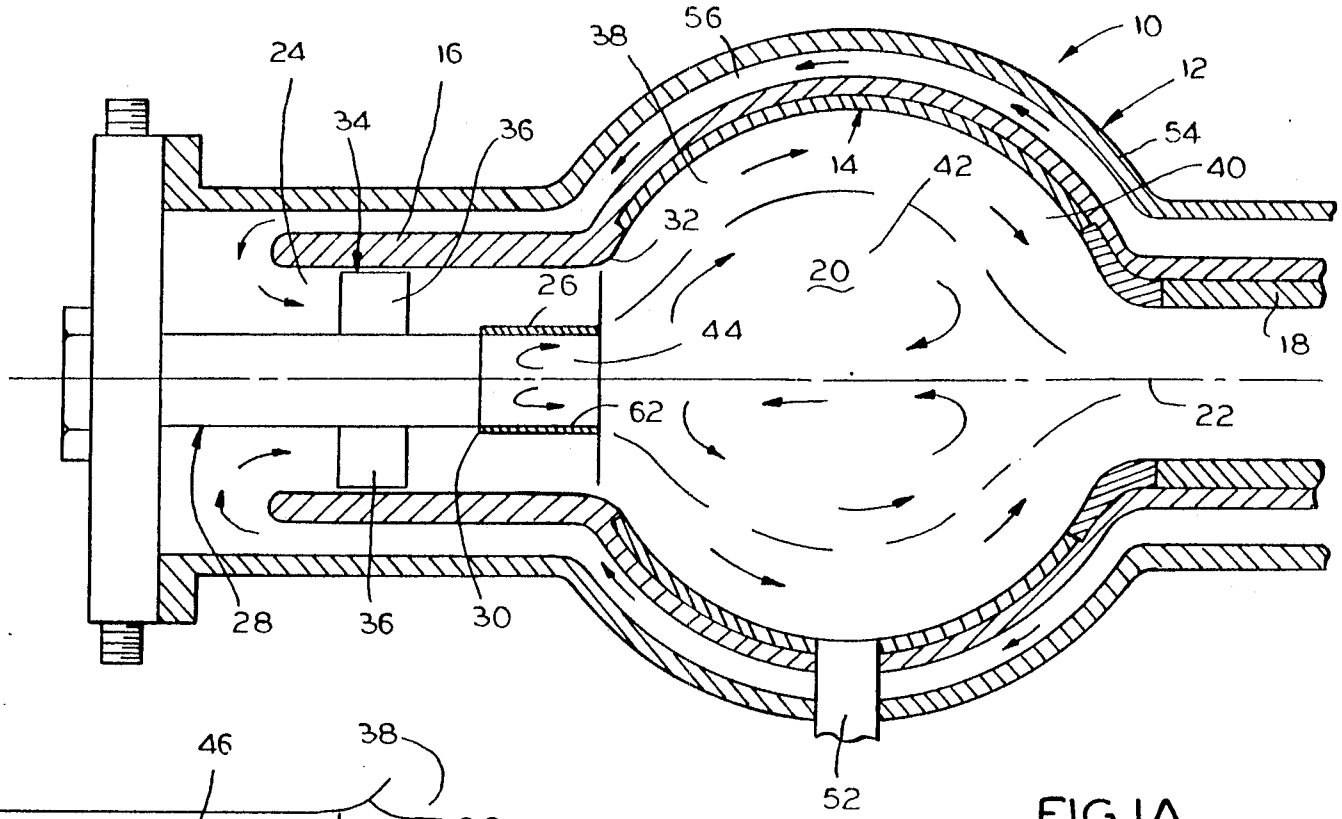
FIG. 1*a* is a partially schematic, partially sectional view of another embodiment of a stored energy combustor in accordance with the present invention.

Preferably, the stored energy combustors of FIGS. 1 and 1*a* are identical in all respects other than the location of the igniters 50 and 52, respectively.

As will now be appreciated, the fuel injector 28 and igniter 50 in FIG. 1 are withdrawn substantially from the plane at the juncture of the tubular extension 16 and the combustion chamber 20. This plane defines the point of entry as at 32 into the combustion chamber 20, and it is the location of the fuel injector 28 upstream of the point of entry as at 32 which results in the minor zone of recirculating gases as at 44 once ignition is achieved. Thereafter, the minor zone of recirculating gases as at 44 provides instantaneous ignition as at 62 so as to establish what may be thought of as an annulus of initial inflammation.

Referring to FIG. 1, the igniter 50 is located very close to the generally laminar annulus of fine fuel droplets as at 26 in a sheltered zone defined by the recirculating gases as at 44 to provide favorable conditions for ignition. Typically, only a single spark will be required for ignition. Thereafter, the spark may be shut off to preserve the life of the igniter 50 and, from that point forward, instantaneous ignition will assure avoidance of fuel freeze as the temperature of the oxidant entering at the oxidant inlet port 24 rapidly drops.

As will also be appreciated from a consideration of FIG. 2, the minor zone of recirculating gases as at 44 causes inflammation of the outer periphery of the generally laminar annulus of fine fuel droplets as at 26. Ignition is obtained at the outer periphery inasmuch as this is the juncture of available oxidant from the oxidant inlet port 24 and the available fuel. At the inner periphery of the generally laminar annulus of fine fuel droplets as at 26, there is fuel and hot recirculating gases which contain no oxidant but only the products of combustion.

Thus, the absence of oxidant prevents combustion at the inner periphery of the generally laminar annulus of fine fuel droplets as at 26. But ignition is obtained after the initial spark by the immediate proximity of the hot recirculating gases as at 44 to the juncture of fuel and oxidant.

As will also be appreciated, the swirling oxidant in the tubular extension 16 will tend to centrifuge the heavier fuel droplets outwardly. Conversely, the ring of flame at the interface between the swirling oxidant and fuel will want to remain at the interface, i.e., the ring of flame, being hot, will result in "g" forces constraining it from moving outwardly into the heavier swirling annulus of oxidant. In practice, this ring of flame will provide an exceptionally favorable environment for very fast fuel evaporation.

As a result, the very fast fuel evaporation prevents liquid phase smoke (carbon) and the fuel droplets tending to be centrifuged through the ring of flame will evaporate, be heated and converted to a gas. The fuel droplets will therefore be constrained by "g" forces from moving further outwardly. In other words, the annulus of hot, vaporized fuel and outwardly adjacent annulus of flame will stratify and become laminar while being constrained by the heavier outer swirling oxidant annulus.

Thus, no matter what the fuel flow rate, at the point of ignition as at 62, there will always be a near stoichiometric mixture of fuel and air at the outer periphery thereof. With ignition achieved initially from the igniter 50 (or the igniter 52 in FIG. 1*a*), or subsequently from the minor zone of recirculating gases as at 44, excellent flame stability is achieved. In addition, easy ignition is provided over a wide range of fuel flows, and the flame can operate very fuel rich, and close to the rich limit, when required or desired.

Because the fuel cannot mix with the air due to the stratification as explained hereinabove, very little fuel is burned. It is therefore necessary at the point of entry as at 32 to the combustion chamber 20 to cause an "enlargement" so that the swirling mass of air, flame and fuel can expand radially which, in turn, reduces the "g"

forces and increases turbulence, mixing and reaction of oxidant and fuel. When this occurs, it is possible to achieve blue flame smokeless combustion even with difficult fuels, such as JP10.

As a result, carbon buildup on the interior wall 14 in the region of the combustion chamber 20 is greatly minimized, and the blue flame, having much less radiation than a typical smoky flame, also makes wall cooling much easier. Practically speaking, all of this is best achieved when the generally laminar annulus of fine fuel droplets as at 26 is very narrow and exactly positioned at the interface between the swirling oxidant annulus as at 46 and the minor zone of hot recirculating gases as at 44.

While in the foregoing there have been set forth preferred embodiments of the invention, it will be appreciated that the details herein given may be varied by those skilled in the art without departing from the true spirit and scope of the appended claims.

We claim:

1. A stored energy combustor, comprising:

a vessel having a wall defining narrow, spaced apart inlet and outlet ends interconnected by a relatively wide combustion chamber;

said vessel having a longitudinal axis extending from said inlet end through said combustion chamber to said outlet end thereof, said inlet end and outlet end being generally tubular extensions of said vessel leading to and from said combustion chamber;

an oxidant inlet port upstream of said combustion chamber for directing oxidant into said combustion chamber, said oxidant inlet port being concentric with said longitudinal axis of said vessel at said inlet end;

fuel injection means in said tubular extension of said vessel leading to said combustion chamber, said fuel injection means having a discharge end upstream of a plane defining a point of entry into said combustion chamber for directing an annulus of fuel toward said combustion chamber, said fuel injection means being concentric with said longitudinal axis of said vessel;

said oxidant inlet port directing oxidant into said combustion chamber through said tubular extension of said vessel leading to said combustion chamber in surrounding relation to said fuel injection means;

means upstream of said combustion chamber and said discharge end of said fuel injection means for swirling said oxidant in said tubular extension of said vessel leading to said combustion chamber, said tubular extension of said vessel leading to said combustion chamber directing oxidant in a swirling annulus into said combustion chamber outwardly of said annulus of fuel; and means for igniting said oxidant and said fuel to produce hot gases of combustion;

said fuel injection means comprising a fuel injector having a fuel passageway extending in generally concentric relation to said longitudinal axis of said vessel, said igniting means being disposed within said fuel injector radially inwardly of said fuel passageway for igniting said oxidant and said fuel.

2. The stored energy combustor of claim 1 wherein said fuel injector is formed such that said fuel passageway terminates in a cylindrical fuel nozzle for directing said annulus of fuel in the form of a cylindrical array of fine fuel droplets toward said combustion chamber.

3. The stored energy combustor of claim 2 wherein said tubular extension of said vessel leading to said combustion chamber directs oxidant into said combustion chamber outwardly of said cylindrical array of fine fuel droplets from said cylindrical fuel nozzle.

4. A stored energy combustor, comprising:

a vessel having an interior wall defining narrow, spaced apart inlet and outlet ends interconnected by a relatively wide combustion chamber;

said vessel having a longitudinal axis extending from said inlet end through said combustion chamber to said outlet end thereof, said combustion chamber being generally spherical, said inlet end and outlet end being generally tubular extensions of said vessel leading to and from said combustion chamber;

an oxidant inlet port upstream of said combustion chamber for directing oxidant into said combustion chamber, said oxidant inlet port being concentric with said longitudinal axis of said vessel at said inlet end;

fuel injection means in said tubular extension of said vessel leading to said combustion chamber, said fuel injection means having a discharge end upstream of a plane at the juncture of said tubular extension and said combustion chamber defining a point of entry into said combustion chamber for directing a generally laminar annulus of fine fuel droplets along said tubular extension toward said combustion chamber, said fuel injection means being concentric with said longitudinal axis of said vessel;

said oxidant inlet port directing oxidant into said combustion chamber through said tubular extension of said vessel leading to said combustion chamber in surrounding relation to said fuel injection means and said generally laminar annulus of fine fuel droplets;

means upstream of said combustion chamber and said discharge end of said fuel injection means for swirling said oxidant in said tubular extension of said vessel leading to said combustion chamber, said tubular extension of said vessel leading to said combustion chamber directing oxidant in a swirling annulus into said combustion chamber outwardly of said generally laminar annulus of fine fuel droplets; and means for igniting said oxidant and said fuel to produce hot gases of combustion;

said fuel injection means comprising a fuel injector including a double-walled hollow tube defining a fuel passageway extending in generally concentric relation to said longitudinal axis of said vessel, said igniting means being disposed within said double-walled hollow tube of said fuel injector radially inwardly of said fuel passageway for igniting said oxidant and said fuel in said combustion chamber.

5. The stored energy combustor of claim 4 wherein said fuel injector is formed such that said fuel passageway terminates in a cylindrical fuel nozzle for directing said generally laminar annulus of fine fuel droplets toward said combustion chamber.

6. The stored energy combustor of claim 4 wherein said vessel also has an exterior wall in closely spaced relation to said interior wall to define an oxidant flow path extending substantially completely about said vessel from said outlet end to said inlet end.

7. A stored energy combustor, comprising:

a vessel having an interior wall defining narrow, spaced apart inlet and outlet ends interconnected by a relatively wide combustion chamber;

said vessel having a longitudinal axis extending from said inlet end through said combustion chamber to said outlet end thereof, said combustion chamber being generally spherical, said inlet end and outlet end being generally tubular extensions of said vessel leading to and from said combustion chamber;

an oxidant inlet port upstream of said combustion chamber for directing oxidant into said combustion chamber, said oxidant inlet port being concentric with said longitudinal axis of said vessel at said inlet end;

fuel injection means in said tubular extension of said vessel leading to said combustion chamber, said fuel injection means having a discharge end upstream of a plane at the juncture of said tubular extension and said combustion chamber defining a point of entry into said combustion chamber, said discharge end of said fuel injection means being sufficiently upstream of said point of entry into said combustion chamber for directing a generally laminar annulus of fine fuel droplets along said tubular extension toward said combustion chamber, said generally laminar annulus of fine fuel droplets being directed in such manner as to provide a region within said tubular extension for a minor zone of recirculating gases therewithin, said fuel injection means being concentric with said longitudinal axis of said vessel;

said oxidant inlet port directing oxidant into said combustion chamber through said tubular extension of said vessel leading to said combustion chamber solely in surrounding relation to said fuel injection means and said generally laminar annulus of fine fuel droplets;

means upstream of said combustion chamber and said discharge end of said fuel injection means for swirling said oxidant in said tubular extension of said vessel leading to said combustion chamber, said tubular extension of said vessel leading to said combustion chamber directing oxidant in a swirling annulus into said combustion chamber outwardly of said generally laminar annulus of fine fuel droplets; and means for igniting said oxidant and said fuel to produce hot gases of combustion;

said swirling oxidant annulus expanding radially outwardly within said combustion chamber upon exiting said tubular extension of said vessel leading to said combustion chamber, said swirling oxidant annulus contracting radially inwardly within said combustion chamber upon approaching said tubular extension of said vessel leading from said combustion chamber;

said swirling oxidant annulus causing a major zone of recirculating gases inwardly of said interior wall in said combustion chamber and a minor zone of recirculating gases in said region within said tubular extension inwardly of said generally laminar annulus of fine fuel droplets;

said generally laminar annulus of fine fuel droplets thereby being directed between said swirling oxidant annulus and said minor zone of recirculating gases within said tubular extension of said vessel leading to said combustion chamber.

8. The stored energy combustor of claim 7 wherein said vessel also has an exterior wall in closely spaced relation to said interior wall to define an oxidant flow path extending substantially completely about said vessel from said outlet end to said inlet end.

9. The stored energy combustor of claim 7 wherein said oxidant swirling means comprises an air swirler including a plurality of vanes for spinning oxidant in said tubular extension of said vessel leading to said combustion chamber to a swirl angle of between 40 and 70 degrees.

10. The stored energy combustor of claim 7 wherein said fuel injection means comprises a fuel injector including a double-walled hollow tube defining a fuel passageway extending in generally concentric relation to said longitudinal axis of said vessel.

11. The stored energy combustor of claim 10 wherein said fuel injector is formed such that said fuel passageway terminates in a cylindrical fuel nozzle for directing said generally laminar annulus of fine fuel droplets toward said combustion chamber.

12. The stored energy combustor of claim 10 wherein said igniting means is disposed within said double-walled hollow tube of said fuel injector radially inwardly of said fuel passageway for igniting said oxidant and said fuel in said combustion chamber.

13. The stored energy combustor of claim 10 wherein said igniting means is disposed within said interior wall of said vessel at a point within said combustion chamber for igniting a mixture of oxidant from said oxidant inlet port and fuel from said fuel injection means.

* * * * *